US011044966B2

(12) United States Patent
Kleinsasser et al.

(10) Patent No.: US 11,044,966 B2
(45) Date of Patent: Jun. 29, 2021

(54) DOUBLE SIDED ADHESIVE TAPE WITH RELEASE TAB FOR ENHANCED SHOE ADHERENCE TO SKIN AND REMOVAL

(71) Applicant: Ste-Ke Enterprises, LLC, Fort Worth, TX (US)

(72) Inventors: Lindsay S. Kleinsasser, Fort Worth, TX (US); Barbara M. Reder, Fort Worth, TX (US)

(73) Assignee: Ste-Ke Enterprises, LLC, Fort Worth, TX (US)

( * ) Notice: Subject to any disclaimer, the term of this patent is extended or adjusted under 35 U.S.C. 154(b) by 170 days.

(21) Appl. No.: 16/543,908

(22) Filed: Aug. 19, 2019

(65) Prior Publication Data

US 2019/0365051 A1 Dec. 5, 2019

Related U.S. Application Data

(62) Division of application No. 15/551,250, filed as application No. PCT/US2016/018101 on Feb. 16, 2016, now Pat. No. 10,383,402.

(60) Provisional application No. 62/117,314, filed on Feb. 17, 2015.

(51) Int. Cl.
*A43B 23/28* (2006.01)

(52) U.S. Cl.
CPC ..... *A43B 23/28* (2013.01)

(58) Field of Classification Search
CPC ..... A43B 23/28; A43B 7/223; A43B 17/18; A43B 21/32
See application file for complete search history.

(56) References Cited

U.S. PATENT DOCUMENTS

| | | | | |
|---|---|---|---|---|
| 2,978,818 | A | 4/1961 | Baumann | |
| 2,985,970 | A | 5/1961 | McCarthy | |
| 6,640,465 | B1 * | 11/2003 | Burgess | A43B 7/141 36/15 |
| 8,216,162 | B2 * | 7/2012 | Bushby | A61B 50/00 602/1 |
| 8,677,651 | B2 * | 3/2014 | Cross | A41D 13/06 36/11.5 |
| 10,383,402 | B2 * | 8/2019 | Kleinsasser | A43B 23/28 |

(Continued)

OTHER PUBLICATIONS

International Search Report and Written Opinion, as issued in connection with International Patent Application No. PCT/U52016/018101, dated Apr. 21, 2016, 17 pgs.

*Primary Examiner* — Ted Kavanaugh
(74) *Attorney, Agent, or Firm* — Maschoff Brennan; Jonathan M. Benns

(57) ABSTRACT

A kit includes a tape and instructions for adhering skin to a shoe. The tape having: a substrate; an insole side having an insole adhesive; an insole adhesive liner covering the insole adhesive; a skin side having a skin adhesive, wherein the skin adhesive has a characteristic different from the insole adhesive; a skin adhesive liner covering the skin adhesive; and a release tab formed by a portion of the insole side of the substrate devoid of insole adhesive. The tape can have the following options: the release tab is at the arch end of the substrate; insole side of the substrate has less stick potential compared to the skin side, which results in the insole side being less sticky than the skin side; or insole adhesive has less stick potential compared to the skin adhesive, which results in the insole adhesive being less sticky than the skin adhesive.

20 Claims, 5 Drawing Sheets

(56) References Cited

U.S. PATENT DOCUMENTS

| | | | | |
|---|---|---|---|---|
| 2002/0011010 | A1* | 1/2002 | Smith | A43B 3/107 36/11.5 |
| 2004/0025377 | A1 | 2/2004 | Brannon | |
| 2008/0196270 | A1 | 8/2008 | Small-Vollmann | |
| 2010/0018082 | A1 | 1/2010 | Stokes | |
| 2012/0064304 | A1 | 3/2012 | Bharti et al. | |
| 2019/0069628 | A1* | 3/2019 | Cutler | A43B 7/142 |

* cited by examiner

DOUBLE SIDED ADHESIVE TAPE WITH RELEASE TAB FOR ENHANCED SHOE ADHERENCE TO SKIN AND REMOVAL

CROSS-REFERENCE

This patent application is a divisional of U.S. application Ser. No. 15/551,250 filed Aug. 15, 2017, which is a section 371 nationalization of PCT Application No. PCT/US16/018101 filed Feb. 16, 2016, which claims priority to U.S. Provisional Application No. 62/117,314 filed Feb. 17, 2015, which applications are incorporated herein by specific reference in their entirety.

BACKGROUND

Generally, there are a lot of different types of shoes that can be worn for various occasions. Shoes range from those that are tied tightly to feet with laces, Velcro or the like to flip flops that are made for the heel to release during a stride so that the heel flips on and off the back of the foot. Another type of shoe is one with a harder sole so that it is not made to flip on and off the heel, but lacks laces or Velcro or other attachment mechanism to retain the heel in contact with the insole. These types of shoes are often made to be worn without socks, or at least that may be a preference for the shoe wearer. An example of this type can include high heels or other fashionable shoes. When women walk in high heel shoes, the women often need to grip the toe box of the shoe with the ball of the foot and/or toes to retain the shoe on the foot. However, this can result or allow the heel to lift off of the insole during a normal stride. This heel lifting problem can be solved by shoes that are too small, but this is not comfortable. As a result, women trying to buy shoes often have to decide whether to get the shoes too small or get shoes that fit but will result in their lifting or moving laterally with respect to the insole, even while toe gripping the shoe. The problem of heel lift from the insole occurs because the manufacturers make a heel of a shoe for a one size fits all paradigm; however, heels are different shapes and sizes across different people, especially between genders.

Therefore, it would be advantageous for a device to reduce or inhibit the tendency for heel lift during a stride while a person is wearing a harder sole shoe without socks.

SUMMARY

In one embodiment, a tape is provided for adhering skin to a shoe, the tape can include: a substrate; an insole side of the substrate having an insole adhesive on a portion thereof; an insole adhesive liner covering the insole adhesive; a skin side of the substrate having a skin adhesive on at least a portion thereof, wherein the skin adhesive has a characteristic different from a characteristic of the insole adhesive; a skin adhesive liner covering the skin adhesive; and a release tab formed by a portion of the insole side of the substrate being devoid of the insole adhesive. In one aspect, the substrate is plastic. In one aspect, the substrate is flexible plastic. In one aspect, the substrate is shaped to have a larger heel portion and a narrowed arch portion. In one aspect, the release tab is at the arch end of the substrate. In one aspect, the substrate has a shape as illustrated herein, combination of shapes, portions of shapes, or derivative shapes. In one aspect, the insole side of the substrate has less stick potential compared to the skin side, which results in the insole side being less sticky than the skin side. In one aspect, the insole adhesive has less stick potential compared to the skin adhesive, which results in the insole adhesive being less sticky than the skin adhesive. In one aspect, the insole side of the substrate has more release potential compared to the skin side, which results in the insole side releasing more easily from the insole of the shoe than the skin side releasing from the skin. In one aspect, the insole adhesive has more release potential compared to the skin adhesive, which results in the insole adhesive releasing more easily from the insole of the shoe than the skin adhesive releasing from the skin. In one aspect, the skin adhesive is a medical grade adhesive that is hypoallergenic. In one aspect, the skin adhesive is a pressure sensitive adhesive. In one aspect, the skin adhesive is selected from acrylics, butyl rubber, ethylene-vinyl acetate, natural rubber, nitriles, silicone rubbers, styrene block copolymers, styrene-butadiene-styrene, styrene-ethylene/butyl ene-styrene, styrene-ethyl ene/propyl ene, or styrene-isoprene-styrene that are more sticky than the insole adhesive. In one aspect, the insole adhesive is selected from acrylics, butyl rubber, ethylene-vinyl acetate, natural rubber, nitriles, silicone rubbers, styrene block copolymers, styrene-butadiene-styrene, styrene-ethylene/butyl ene-styrene, styrene-ethylene/propylene, or styrene-isoprene-styrene that are less sticky the skin adhesive. In one aspect, the skin adhesive has a characteristic different from a characteristic of the insole adhesive, and the characteristic is selected from: adhesive type, adhesive amount, adhesive stick potential, and adhesive release potential. In one aspect, the insole adhesive covers the insole side except for the release tab. In one aspect, the skin adhesive covers the skin side except for the release tab. In one aspect, the insole adhesive covers a middle region of the insole side and a perimeter portion of the insole side is devoid of the insole adhesive. In one aspect, the insole adhesive does not cover the entire insole side. In one aspect, the skin adhesive covers a middle region of the skin side and a perimeter portion of the skin side is devoid of the skin adhesive. In one aspect, the skin adhesive does not cover the entire skin side.

In one embodiment, a kit is provided that has at least two of the tapes of any of the embodiments. In one aspect, one of the two tapes can have a left foot contour and one of the two tapes can have a right foot contour. In one aspect, the kit can include use instructions for use of the tapes. In one aspect, the instructions are for application of the tapes to insoles of shoes and skin of heels of the wearer. In one aspect, the instructions are for removal of the tapes from the insoles of shoes. The instructions can include information as described herein.

In one embodiment, a method of adhering a shoe to a foot is provided, the method can include: providing the tape of one of the embodiments; releasing the insole release liner from the insole adhesive; adhering the insole adhesive to an insole of a shoe; releasing the skin release liner; and putting the shoe on the foot so that the skin adhesive adheres to skin of the heel, which method can be performed with one tape and one shoe or with two tapes and two shoes, and which method can include releasing and adhering either the insole adhesive or skin adhesive before the other. The steps can be performed in any order, but adhesives need to be exposed prior to adhering to the insole or skin. In one embodiment, the method can include releasing both the insole release liner and skin release liner of the tape before placing the shoe on the foot. In one aspect, releasing both the insole release liner and skin release liner before placing the tape on the insole of the shoe. In one aspect, the method can include orienting the release tab toward the arch of the insole. In one aspect, the method can include putting the shoe on the foot before releasing the skin adhesive liner so as to adhere the insole adhesive to the insole of the shoe, where the insole of the foot facilitates adhering the insole adhesive to the insole of the shoe, and where the shoe may be removed in order to release the skin adhesive liner before placing the foot back in the shoe to adhere the skin adhesive to the skin. In one aspect, the method can include performing the method for a pair of shoes.

In one embodiment, a method of removing an insole/heel tape from an insole of a shoe is provided, the method comprising: lifting the release tab from the insole; and pulling the release tab so as to remove the insole adhesive from the insole. In one aspect, the method can include removing the tape from the shoe. In one aspect, the method can include peeling the release liner from the insole. In one aspect, the method can include discarding the tape. In one aspect, the method can include performing the method for a pair of shoes.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and following information as well as other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

DETAILED DESCRIPTION

Figure 1:
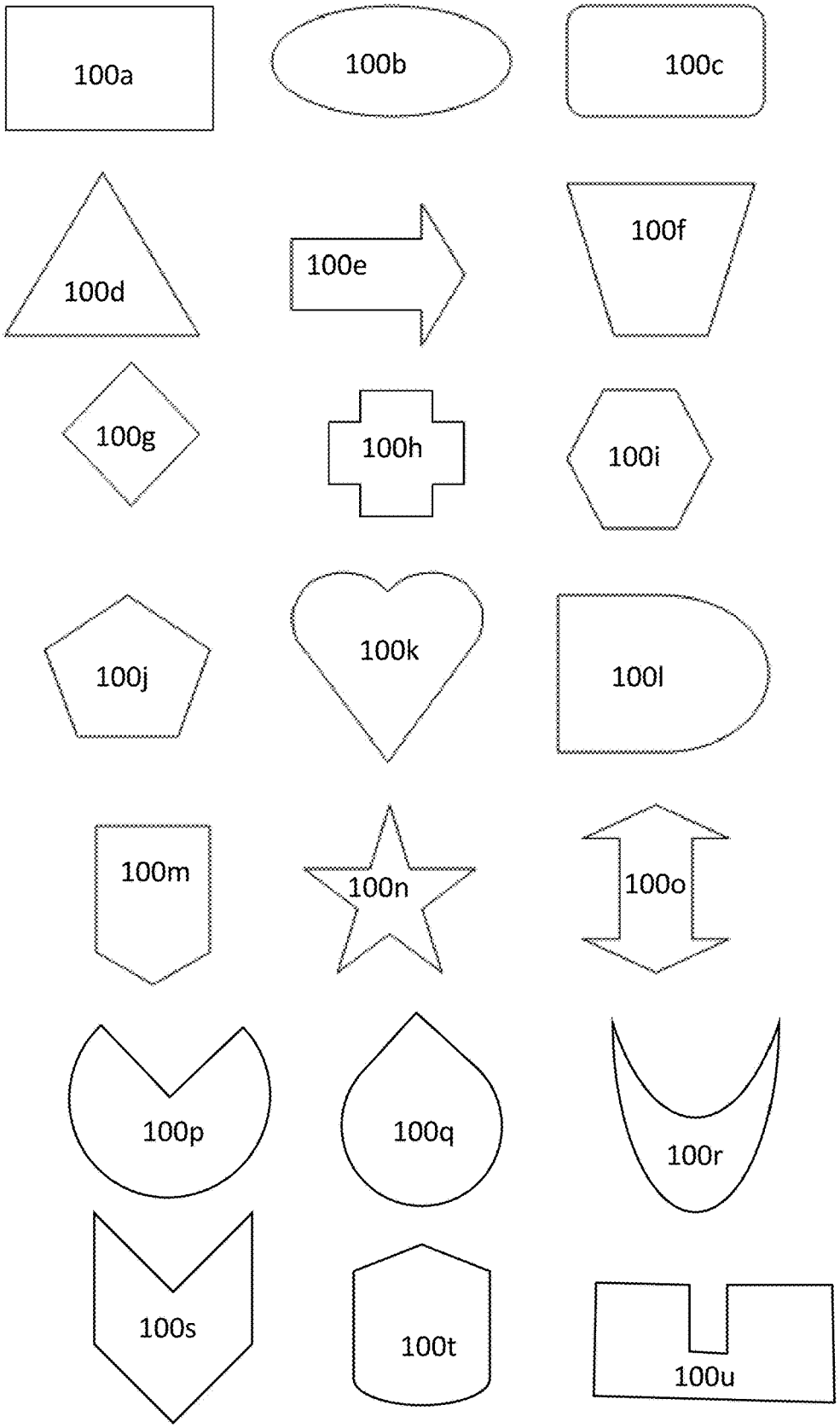
FIG. 1 illustrates different shapes of shoe/foot tapes.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting.

Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Generally, the present technology includes a tape substrate having double sided adhesive with a different adhesive composition on each side, and where the tape substrate has a portion on at least one side that is adhesiveless and configured as a release tab. The tape substrate is configured to be adhered on one side to a shoe insole and the other side to a bottom of a wearer's foot, such as heel or any other portion. The tape substrate can optionally be shaped to conform to a heel shape or other portion of a bottom of the wearer's foot, which can be rounder and larger toward the heel but narrower toward the middle of foot or toe, or vice versa. The release tab can be adhesiveless on one or both sides of the tape substrate. The release tab can be defined as the portion of at least one side of a tape substrate that lacks adhesive, and optionally both sides of the tab can lack adhesive on the tape substrate. Optionally, the skin adhesive side can have the full side of the tape substrate with adhesive and the insole adhesive side can lack adhesive on the release tab.

In one embodiment, the adhesive on the insole side (e.g., insole adhesive) can have less stick potential compared to the adhesive on the skin side (e.g., skin adhesive). The stick potential can be compared by comparative stick to skin, comparative stick to insole or comparative stick to skin or insole. This results in the insole side sticking less to the insole and/or skin compared to the skin side sticking more to the insole and/or skin. This configuration allows for the insole side of the tape to be easily removed from the insole of the shoe without damaging the shoe, and allows for good adherence to the skin. It is preferred that the tape stick more to the skin than to the shoe in this embodiment.

In one embodiment, the adhesive on the insole side (e.g., insole adhesive) can have more release potential (e.g., releases easier) compared to the adhesive on the skin side (e.g., skin adhesive). The release potential can be compared by comparative release force needed from skin, comparative release force from insole or comparative release force from skin or insole. This results in the insole side releasing easier from the insole and/or skin compared to the skin side releasing form the insole and/or skin being more difficult.

In one embodiment, the adhesive on the skin side (e.g., skin adhesive) can have more stick potential compared to the adhesive on the insole side (e.g., insole adhesive). The stick potential can be compared by comparative stick to skin, comparative stick to insole or comparative stick to skin or insole. This results in the skin side sticking more to the insole and/or skin compared to the insole side sticking less to the insole and/or skin.

In one embodiment, the adhesive on the skin side (e.g., skin adhesive) can have less release potential (e.g., release more difficult) compared to the adhesive on the insole side (e.g., insole adhesive). The release potential can be compared by comparative release force needed from skin, comparative release force from insole or comparative release force from skin or insole. This results in the skin side releasing being more difficult from the insole and/or skin compared to the insole side releasing from the insole and/or skin being easier.

The foregoing embodiments with a different adhesive composition on the insole side compared to the skin side of the tape substrate can be accomplished in different ways. In some instances the insole adhesive on the insole side and skin adhesive on the skin side can be the exact same adhesive, but the adhesive is provided in different amounts or concentrations or with other components that modulate the stickiness so that the insole adhesive has less stick compared to the skin adhesive, and the skin adhesive has more stick compared to the insole adhesive. In some instances the adhesive is different. In some instances the adhesive compositions are different enough that there is measurable adherence differences so that the insole adhesive is less sticky and is more easily removed from the insole compared to the skin adhesive that is more sticky and less easily removed from the skin or anything else (e.g., socks, stockings, tights, etc.).

In one embodiment, the release tab may have adhesive on one or both sides. The adhesive on the insole side of the release tab can have less stick potential compared to the rest of the insole side of the substrate. This can allow for the release tab to peel from the insole easily while still allowing for the rest of the insole side being adhered to the insole and maintaining adhesion to the insole. The less stick potential or easier release of the insole side at the release tab allows the release tab to be easily released and pulled from the insole, which in turn allows for the entire substrate to be released from the insole. This can allow for release from the insole without tearing the insole out of the shoe.

In one embodiment, the skin adhesive can be covered with a skin adhesive liner, and/or the insole adhesive can be covered with an insole adhesive liner. The insole adhesive liner is removed for the insole side to be adhered to the insole of the shoe, and then the skin adhesive liner can be removed for the skin side to be adhered to the skin. The skin adhesive liner can cover only the skin adhesive or it can be on the entire skin side. The insole adhesive liner can cover only the insole adhesive or it can be on the entire insole side. Thus, each insole/heel tape can include a substrate with skin adhesive on a skin side with a skin adhesive liner on at least the skin adhesive on the skin side, with insole adhesive on the insole side with an insole adhesive liner on at least the insole adhesive on the insole side, and at least the insole side having a release tab that has no adhesive or significantly less adhesive, and the skin side optionally having no adhesive or significantly less adhesive at the release tab. It should be noted that the release tab is a portion of the substrate and thereby it has a skin side and an insole side, where at least the insole side has no adhesive or significantly less adhesive than the rest of the insole side. The insole adhesive liner and skin adhesive liner may be the same material or have the same coating on the adhesive side of the liner, or the materials or coating can be different and configured for the type of adhesive under the liner.

In one embodiment, the shape of the tape substrate has a heel end and an arch end, where the heel end is configured for being adhered in the heel of the shoe and receiving the heel of the wearer and the arch end is directed toward the arch of the shoe and foot. Often, the arch end has the release tab. The arch end can be narrower than the heel end such that the heel end is wider laterally to accommodate and stick to more of the heel skin. The shape can have a taper from the heel end toward the arch end. Also, the shape of the substrate can conform to the shape of a shoe, such as the heel portion of the shoe. However, any shape can be used, and some shapes can be configured for different types of shoes, such as high heels, flats, flip-flops, or other shoe that may need some adhesive to enhance sticking to the feet of the wearer.

FIG. 1 illustrates some possible shapes 100*a-u* of the substrate. Some of the shapes (e.g., 100*a-t*) can be suitable for heels or flats, and can facilitate adherence to the heel region of a wearer. Some shapes (e.g., 100*p,r,s,u*) may be suitable for flip-flops by having a cutout region that can receive the toe separator of the flip-flop. As such, the tapes can be adapted to have various shapes to conform to any type of shoe from heels to flip-flops so that the shoe adheres to the bottom of the wearer's foot from the heel, middle, arch, balls toes, or any other portion of combinations thereof.

Figure 2:
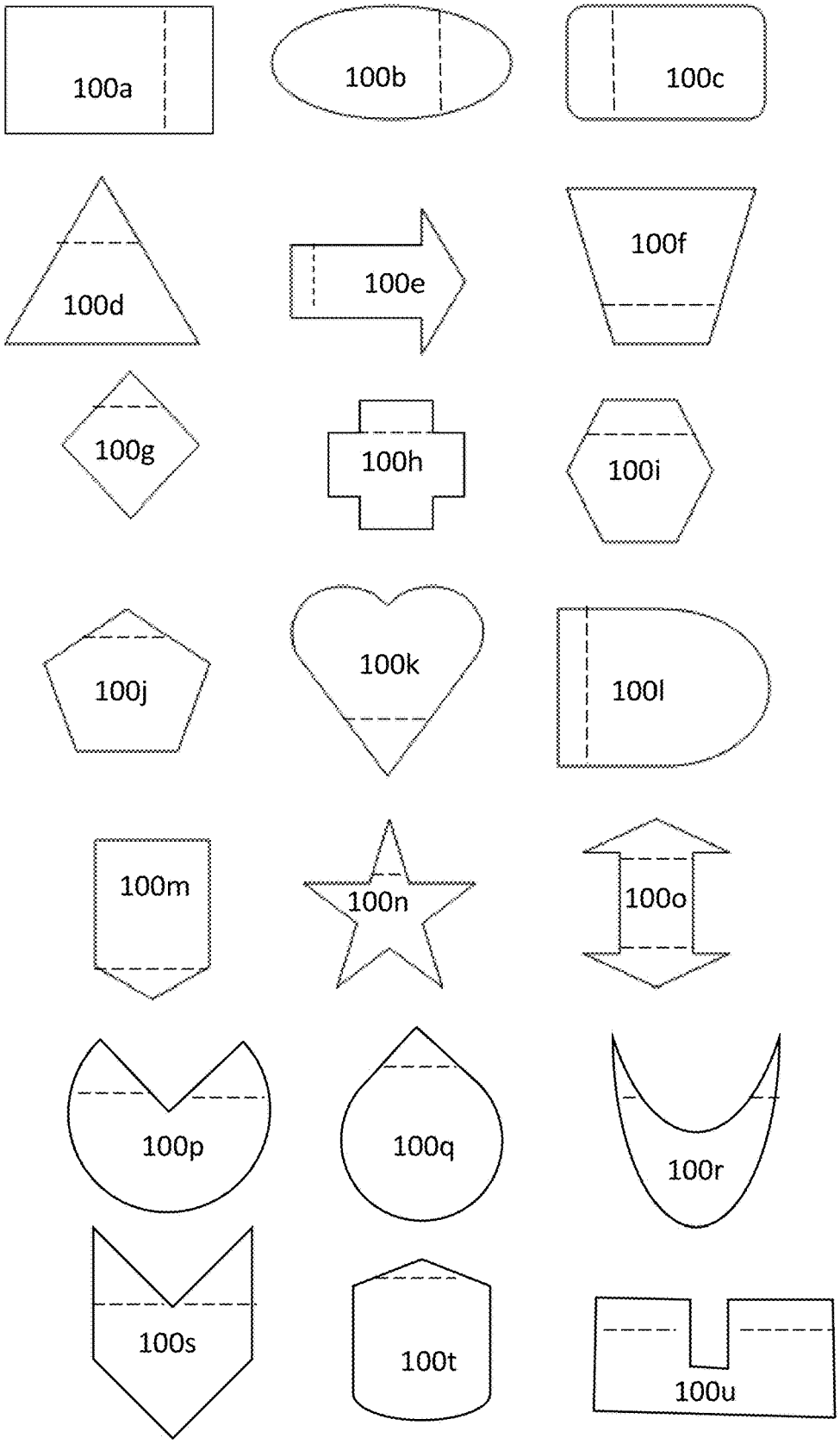
FIG. 2 illustrates different shapes of shoe/foot tapes that have release tabs and release liners.

FIG. 2 illustrates the substrate shapes 100*a-u* of FIG. 1 with the dashed line designating the separation between an adhesive region and a release tab region that does not include adhesive. Generally, the smaller region is the release tab region that does not include adhesive and the larger region is the adhesive region. The illustrated side can be the insole side, skin side, or both the insole side and skin side. Accordingly, FIG. 2 provides examples of the release tab on the substrate, where the release tab is the smaller portion compared to the adhesive portion; however, the release tab can be anywhere on the substrate. The larger portion may also represent the skin release liner and/or insole release liner.

Figure 3:
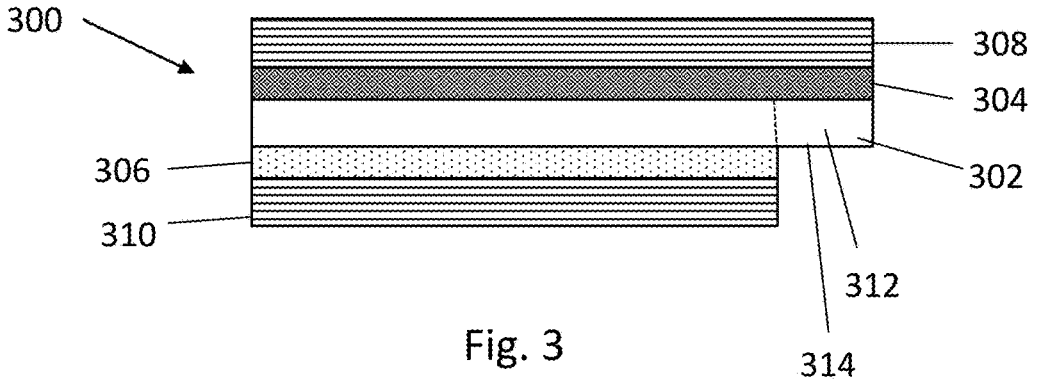
FIGS. 3-3C illustrate cross-sectional side views of embodiments of shoe/foot tapes.

FIG. 3 shows a cross-sectional side view of the tape 300 for adhering the insole of a shoe to a wearer's foot (e.g., directly to skin or to a sock, stocking etc.). As shown, the tape 300 includes a tape substrate 302, which has a skin adhesive 304 on one side (e.g., top side) and a insole adhesive 306 on the other side (e.g., bottom side). The skin adhesive 304 includes a skin release liner 308 opposite of the tape substrate 302. The insole adhesive 306 includes an insole release liner 310 opposite of the tape substrate 302. As shown, the insole adhesive 306 does not cover the entirety of the side of the tape substrate 302, and the uncovered portion 314 forms the release tab 312. It is noted that the insole release liner 310 also does not cover the release tab 312.

Figure 3A:
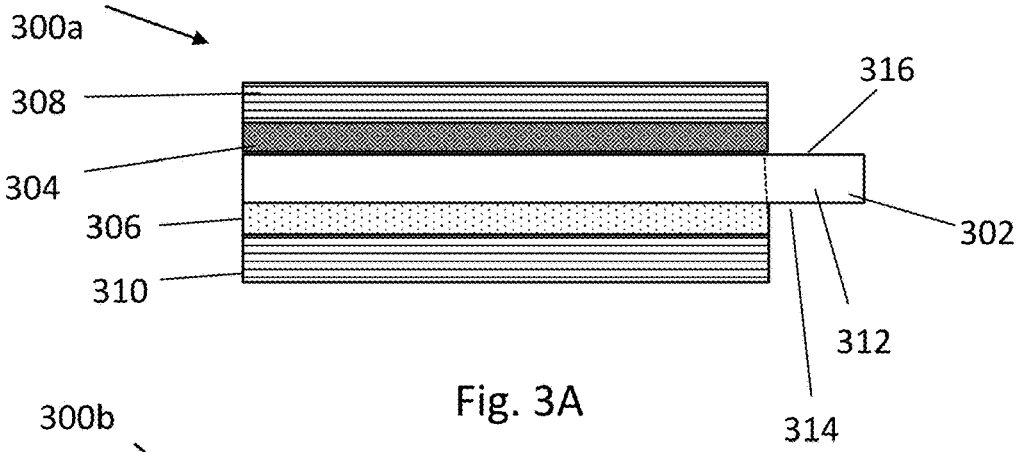
FIG. 3D illustrates a shoe/foot tape having a perimeter release tab.

FIG. 3A shows a cross-sectional side view of another embodiment of the tape 300*a* for adhering the insole of a shoe to a wearer's foot (e.g., directly to skin or to a sock, stocking etc.). As shown, the tape 300 includes a tape substrate 302, which has a skin adhesive 304 on one side (e.g., top side) and a insole adhesive 306 on the other side (e.g., bottom side). The skin adhesive 304 includes a skin release liner 308 opposite of the tape substrate 302. The insole adhesive 306 includes an insole release liner 310 opposite of the tape substrate 302. As shown, the insole adhesive 306 does not cover the entirety of the side of the tape substrate 302, and the uncovered portion 314 forms the release tab 312. It is noted that the insole release liner 310 also does not cover the release tab 312. Additionally, the skin adhesive 304 does not cover the entirety of the side of the tape substrate 302, and the uncovered portion 316 also forms the release tab 312. It is noted that the skin release liner 308 also does not cover the release tab 312.

Figure 3B:
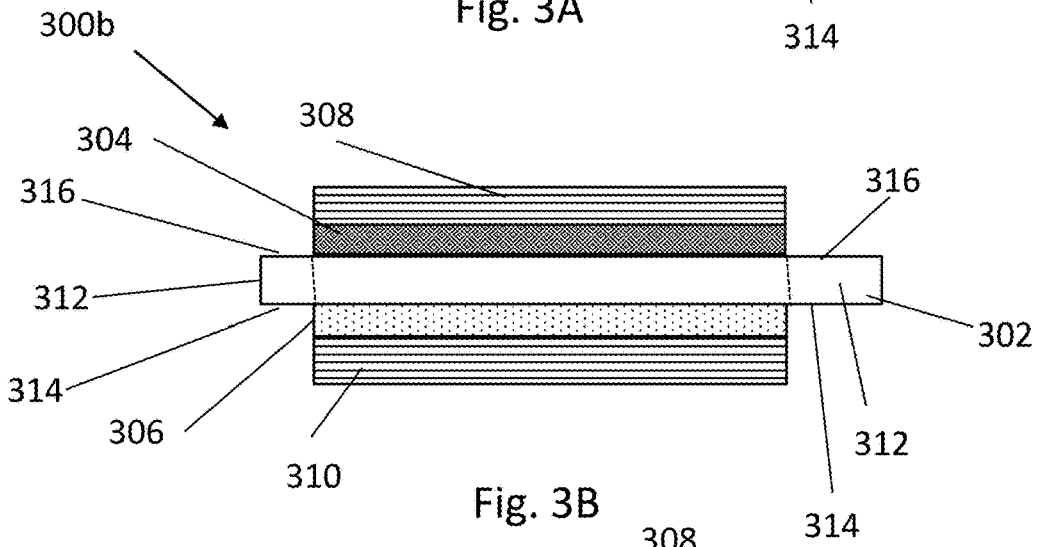

FIG. 3B shows a cross-sectional side view of another embodiment of the tape 300*b* for adhering the insole of a shoe to a wearer's foot (e.g., directly to skin or to a sock, stocking etc.). As shown, the tape 300 includes a tape substrate 302, which has a skin adhesive 304 on one side (e.g., top side) and a insole adhesive 306 on the other side (e.g., bottom side). The skin adhesive 304 includes a skin release liner 308 opposite of the tape substrate 302. The insole adhesive 306 includes an insole release liner 310 opposite of the tape substrate 302. As shown, the insole adhesive 306 does not cover the entirety of the side of the tape substrate 302, and the uncovered portion 314 forms the release tab 312. It is noted that the insole release liner 310 also does not cover the release tab 312. Additionally, the skin adhesive 304 does not cover the entirety of the side of the tape substrate 302, and the uncovered portion 316 also forms the release tab 312. It is noted that the skin release liner 308 also does not cover the release tab 312. Also, tape 300*b* includes the release tab 312 on both sides, which can be for a tape substrate 100*o* or a tape 300*d* as shown in FIG. 3D that has the release tab 312 in a perimeter around the adhesive and release liner 320.

Figure 3C:
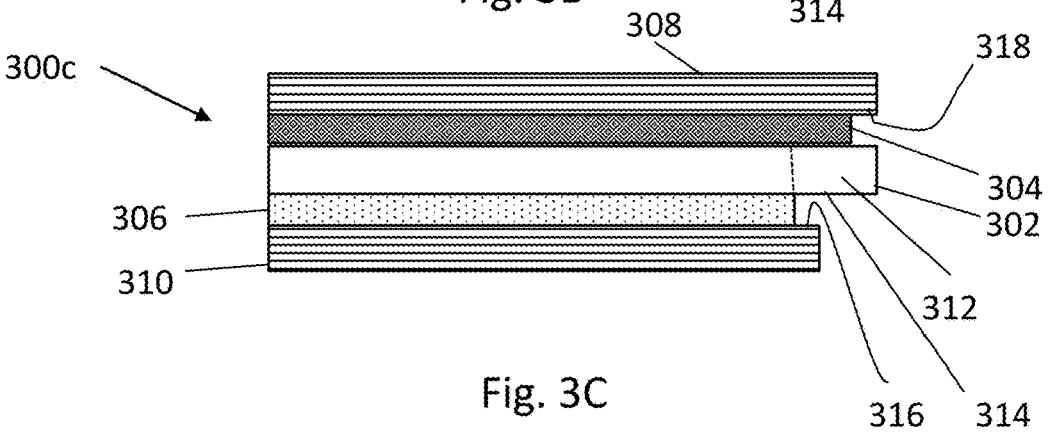
Figure 3D:
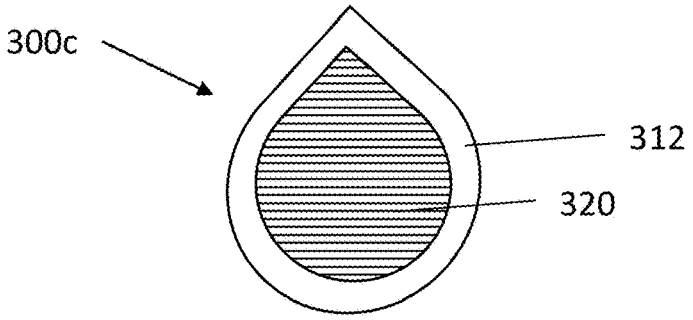

FIG. 3C shows a cross-sectional side view of another embodiment of the tape 300*b* for adhering the insole of a shoe to a wearer's foot (e.g., directly to skin or to a sock, stocking etc.). As shown, the tape 300 includes a tape substrate 302, which has a skin adhesive 304 on one side (e.g., top side) and a insole adhesive 306 on the other side (e.g., bottom side). The skin adhesive 304 includes a skin release liner 308 opposite of the tape substrate 302. The insole adhesive 306 includes an insole release liner 310 opposite of the tape substrate 302. As shown, the insole adhesive 306 does not cover the entirety of the side of the tape substrate 302, and the uncovered portion 314 forms the release tab 312. It is noted that the insole release liner 310 also does not cover the release tab 312. Additionally, the skin adhesive 304 does not cover the entirety of the side of the tape substrate 302, and the uncovered portion 316 also forms the release tab 312. It is noted that the skin release liner 308 also does not cover the release tab 312. Additionally, it is noted that the insole release liner 310 has an overhang 316 that allows the insole release liner 310 to be easily removed from the insole adhesive 306. Also, it is noted that the skin release liner 308 has an overhang 318 that allows the skin release liner 308 to be easily removed from the skin adhesive 304.

Figure 4:
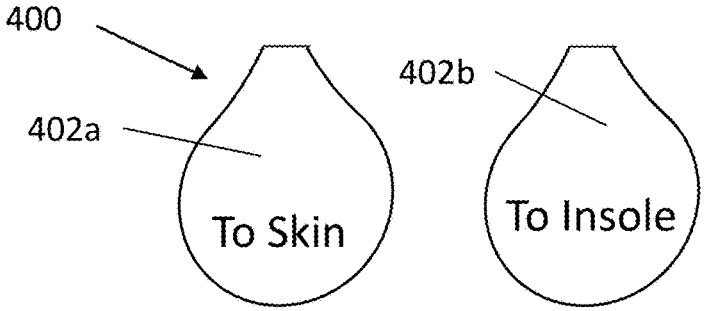
FIGS. 4-4A illustrate kits of two shoe/foot tapes that have indicia.
Figure 4A:
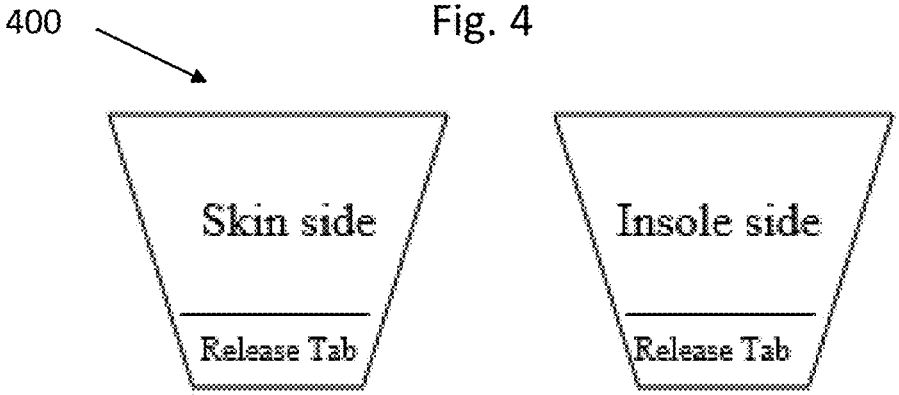

In one embodiment, a kit 400 can include at least two insole/heel tapes. FIG. 4 shows such as kit 400 that has at least a first tape 402*a* and a second tape 402*b*; however, the kit can include any number of the tapes. All the tapes may be the same in the kit 400, or some may be different from others. The two insole/heel tapes can be identical, or one can be configured (e.g., shaped) for the left foot and the other can be configured (e.g., shaped) for the right foot. The kit can come in even numbers of insole/heel tapes, such as 2, 4, 6, 8, 10, 12, and so on. The tapes may also include indicia that identifies which side should be applied to skin (e.g., "To Skin") and which side should be applied to the insole (e.g., "To Insole"). FIG. 4A shows an alternative embodiment of the kit 400*a* having the tapes where the sides are labeled and the release tab is labeled.

Accordingly, each insole/heel tape can be shaped and have different types of adhesive on each side with a release tab on an end. The release tab is not sticky on either side. The different types of adhesive can be regular adhesive for inanimate objects on the insole side and medical grade adhesive or hypoallergenic, such as pressure sensitive adhesive (PSA) on the skin side. The difference can be in stick factor or stick release factor. The grading for the two different adhesives can be different.

In one embodiment, the release tab is at the arch end and/or narrowed end, and it is designed with the tab at the bottom specifically to reduce the likelihood of ripping the insole out of the shoe when the user is releasing it. Accordingly, the release starts from the center point of the insole where it is secure; not on the edges or heel of the insole that can result in pulling the insole out of the shoe from the heel. Thus, the release tab can be located proximal to the arch and opposite of the heel end. However, the release tab can be positioned anywhere in the shoe in some instances as the adherence of the insole adhesive can be reduced to allow for easy removal.

The material of the substrate may be any suitable plastic that is used for any tape, such as any double sided tape. The substrate has a certain strength so it doesn't tear when pulling it off the skin or insole. The substrate has to be able to function the way it needs to function to adhere a heel to an insole, and then to release without the substrate tearing. Traditional tape substrates may be used, such as any type of tape substrate.

In one embodiment, the release tab on the insole side has no adhesive or such a small amount adhesive that it easily peels from the insole. The skin side of the release tab may or may not have any adhesive, which adhesive can be the same or different from the rest of the skin side.

In one embodiment, the shape opposite of the release tab is heel-shaped or circular, but can be substantially any shape and dimension that will fit in the heel of the shoe, and an optimum shape is kind of heel-shaped as in the photograph herein.

One of the features of the insole/heel tapes can be related to the size of the user, so a kit can have different sized insole/heel tapes or different kits can be sold in different sizes, such as XS, S, M, L, XL and XXL or the like. The size can be the lateral dimension orthogonal with the dimension from arch to heel end, or the size can be related to the size of the person wearing it and the surface area of it.

In one embodiment, each insole/heel tape can have indicia on the skin side that identifies the adhesive on the skin side is suitable for adherence to the skin, and/or have indicia on the insole side that identifies the insole side is suitable for adherence to the insole. The indicia may just be different patterns on one side versus the other with some information, such as in the instruction packet, on which side is the skin side and which side is the insole side. See FIGS. 4-4A for examples. While the indicia may be on the substrate, the indicia may be more suitable for being on the skin adhesive liner and/or insole adhesive liner. The substrate, adhesive, and/or liners may be clear, and any of them may be opaque. A clear substrate can be useful for fashion, as well as clear adhesive. The liners may be clear or opaque.

Figure 4B:
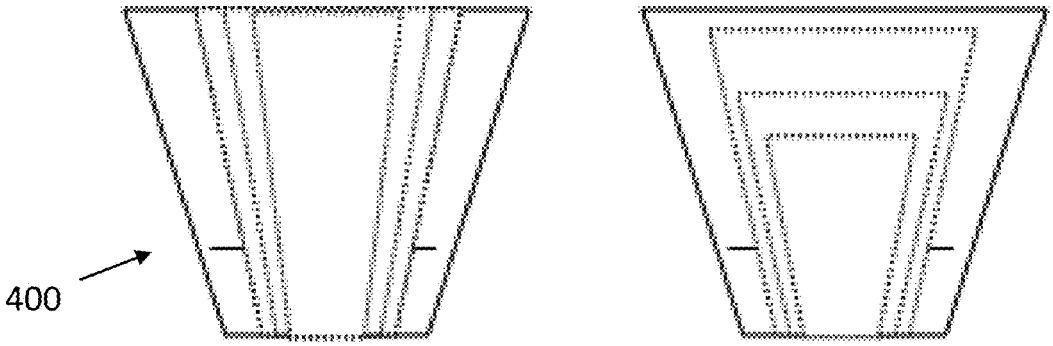
FIG. 4B illustrates embodiments of shoe/foot tapes that have cutting lines.

In one embodiment, each insole/heel tape can have indicia on the skin side that identifies cut lines for cutting the tape to fit a certain size of heel or fit in a certain size of shoe heel, and/or have indicia on the insole side that identifies cut lines for cutting the tape to fit a certain size of heel or fit in a certain size of shoe heel. The indicia may be different patterns, with some information such as in the instruction packet, on how or where to cut the tape. See FIG. 4B for examples that show the dashed lines as cutting lines. While the indicia may be on the substrate, the indicia may be more suitable for being on the skin adhesive liner and/or insole adhesive liner. Cutline indicia can be beneficial because the size of the heel and size of the shoe matters.

Figure 5:
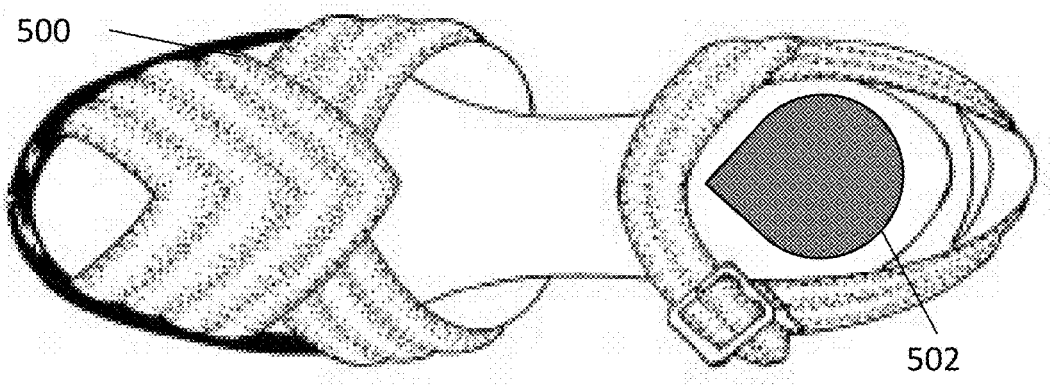
FIGS. 5-5D illustrate embodiments of shoes having shoe/foot tapes adhered to insoles of the shoes.

FIG. 5 shows a shoe 500 that includes the tape 502. As shown, the tape 502 is applied to the heel region of the shoe 500 so that the heel can be held down onto the insole of the shoe. While the shoe 500 has a strap, such straps may not hold the heel down for comfortable walking without heel lift. Now, with the tape 502, the heel can be fastened and adhered to the insole of the shoe 500 so that walking can be performed without heel lift.

Figure 5A:
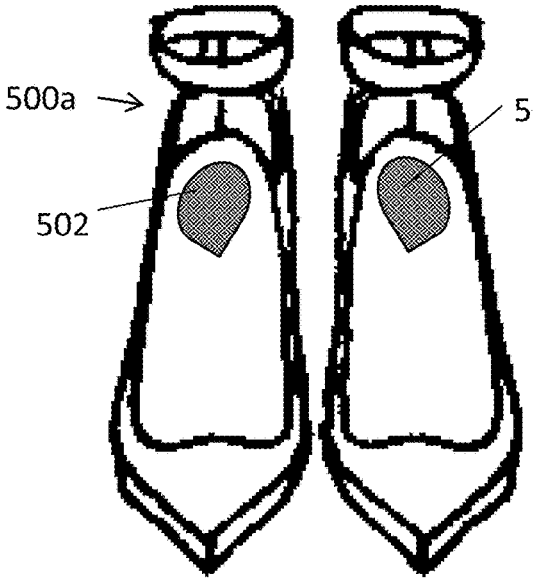

FIG. 5A shows a pair of shoes 500*a*, where each shoe includes the tape 502. As shown, the tape 502 is applied to the heel region of each of the pair of shoes 500*a* so that the heel can be held down onto the insole of the shoe. While the pair of shoes 500*a* has an ankle strap, such straps may not hold the heel down for comfortable walking without heel lift. Now, with the tape 502, the heel can be fastened and adhered to the insole of the pair of shoes 500*a* so that walking can be performed without heel lift. Also, the shoes 500*a* may be provided and purchased with the tape 502.

Alternatively, the pair of shoes 500*a* can be provided and purchased with one or more pair of tapes 502.

Figure 5B:
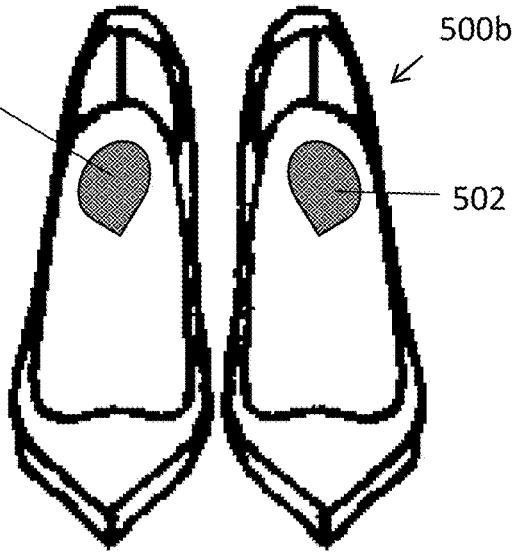

FIG. 5B shows a pair of shoes 500*b*, where each shoe includes the tape 502. As shown, the tape 502 is applied to the heel region of each of the pair of shoes 500*b* so that the heel can be held down onto the insole of the shoe. The pair of shoes 500*b* does not have any type of strap can be susceptible to heel lift. Now, with the tape 502, the heel can be fastened and adhered to the insole of the pair of shoes 500*b* so that walking can be performed without heel lift. Also, the shoes 500*b* may be provided and purchased with the tape 502. Alternatively, the pair of shoes 500*b* can be provided and purchased with one or more pair of tapes 502.

Figure 5C:
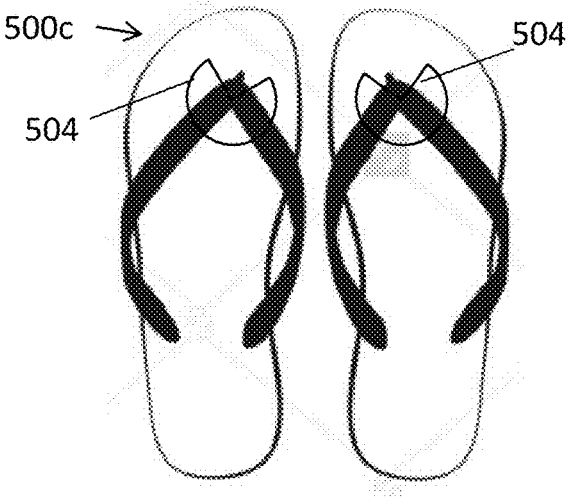

FIG. 5C shows a pair of flip-flops 500*c*, where each flip-flop includes the tape 504. The tape 504 is shown to have a cutout that can receive the toe separator of the flip-flops as shown, which results in a portion of the tape 504 on each side of the toe separator and a portion for the ball region of the feet. In this embodiment, the tape 504 keeps the ball of the feet adhered to the flip-flops, and without a tape on the heel the flip-flops can have heel lift as is normal. Thus, the tape 504 inhibits toe lift of ball of feet lift from the flip-flops to keep them retained on the feet during walking.

Figure 5D:
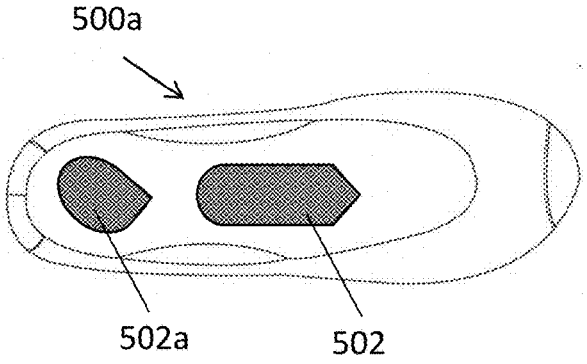

FIG. 5D shows a shoe 500*a* that includes two tapes 502*a*,502*b*. However, more than two tapes can be used if needed. While not shown, a ball of foot tape (e.g., 504) may also be used for the ball of foot region. As shown, the two tapes 502*a*,502*b* have different shapes, where the tape 502*a* is shaped for the heel, and the tape 502*a* is shaped for the instep of the foot. Accordingly, a kit may be provided with tapes that have different shapes, such as the two tapes 502*a*,502*b*, or more than two different shapes.

For heavier, bigger footed people, the tape may be bigger because there's more weight pushing on their heels when they walk. The size of the lateral or cross dimension being sufficient may be more important than from heel to toe direction. If the wearer has a high arch, then it doesn't really matter how long it is because the foot is going to come up off the insole on a certain point, but if flat-footed then the wearer could have it half way down and it would work.

In one embodiment, the tape is not configured for or used for the back of the heel, which is the part that extends upward and vertically from the base of the foot. The tapes are for the insoles and the bottoms of feet.

In one embodiment, the tape allows a wearer to wear a pair of shoes that's one, two, or more sizes too big and the heel will still stay in the shoes without lift off.

In one embodiment, the use of the tapes is for harder sole shoes that are not supposed to have heel lift. Examples include high heels or backless shoes. In one aspect, the tapes are not for flip flop type shoes that are supposed to have heel lift—they are made to move off the heel of the foot. In one aspect, the tapes are for shoes that are meant to stick to the heel without lift off from the insole. In one aspect, the tape allows for one size of shoe to fit all. In one aspect, the tape can be used on the ball region of the foot to increase contact with the foot and flip-flop and still allow heel lift from the flip-flop.

In one embodiment, the tape keeps the heel from sliding anywhere—forward or backward or to either side—relative to the insole, such as in all three dimensions.

In one embodiment, the tape can have the same adhesive on both sides, but there is less adhesive on the insole side compared to the more sticky skin side. The skin side on this one is stickier and the insole side is less sticky, where the adhesives can be the same or different. For example, the insole side can have less adhesive and thereby less stick compared to the skin side.

The less stick on the insole side allows removal without tearing the insole from the shoe. Also, the location of the release tab being on the arch side or located at the middle of the insole of the shoe can be advantageous.

In one embodiment, a method of adhering an insole to skin of a human foot, such as the heel, can include: releasing the insole adhesive liner; adhering the insole adhesive to the insole of the shoe; removing the skin adhesive liner; and adhering the skin adhesive to the skin of the heel. The method can include: peeling release liner (e.g., insole adhesive release liner) from one adhesive (e.g., insole adhesive) side; placing exposed adhesive (e.g., insole adhesive) onto shoe insole, and optionally pressing firmly to adhere the middle to the edges of the tape; peel release liner (e.g., skin adhesive release liner) from other adhesive (e.g., skin adhesive); and place foot into show so as to be on the other adhesive (e.g., skin adhesive). The shoe is not adhered to the foot.

In one embodiment, a method of releasing the shoe from the foot of the wearer can include: removing the skin of the heel from the skin adhesive and withdrawing the foot from the shoe; and pulling the release tab from the insole so as to remove the tape from the insole.

In one embodiment, a kit can include instructions on use, such as instructions for the method of adhering and instructions on the method of releasing.

In one embodiment, the tape is used without socks or hose covering the foot. This results in the wearer having bare feet before adhering the shoe to the heel.

In one embodiment, a kit can include a pair of shoes and at least a pair of insole/heel tapes.

In one embodiment, a shoe can include an insole/heel tape adhered to the insole of the shoe. While any shoe can be included, it may be preferable for the shoe to be devoid of laces or Velcro attachment mechanisms or any other attachment mechanism. High heels are just one non-limiting example. A pair of shoes, each having the tape adhered to the insole can also be provided.

In one embodiment, the tape can include the following: a plastic liner coated with silicone (e.g., 5.6 mils); medical grade acrylic adhesive that has more stick (e.g., 1.4 mils); a polyester film substrate (e.g., 0.5 mil); acrylic adhesive that has less stick (0.5 mils); and a plastic liner coated with silicone (e.g., 5 mils). The medical grade acrylic adhesive (e.g., skin adhesive) can have a strength of 27.4 N/25 mm, and the other adhesive (e.g., liner adhesive) can have a strength of 17.8 N/25 mm.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A kit for use in adhering a shoe to a bottom of a foot, the kit comprising:

at least two tapes, each tape comprising:

a substrate having a wider heel end that tapers to a narrower arch end;

an insole side of the substrate having an insole adhesive on at least a portion thereof;

an insole adhesive liner covering the insole adhesive including indicia on an outer surface marking for adhering to an insole;

a skin side of the substrate having a skin adhesive on at least a portion thereof, wherein the skin adhesive has a characteristic different from a characteristic of the insole adhesive;

a skin adhesive liner covering the skin adhesive including indicia on an outer surface marking for adhering to skin; and a release tab at the arch end formed by a portion of the arch end of the insole side of the substrate being devoid of the insole adhesive; and instructions for using each tape for adhering skin to insoles of a pair of shoes, the instructions comprising steps for:

releasing the insole release liner from the insole adhesive;

adhering the insole adhesive to an insole of a shoe with the wider heel end at a heel region of the insole and the narrower arch end toward an arch region of the insole;

releasing the skin release liner; and putting the shoe on the foot so that the skin adhesive adheres to skin of the bottom of the foot at the heel to inhibit heel lift from the insole.

2. The kit of claim 1, wherein the instruction comprise a step for one of:

releasing both the insole release liner and skin release liner before placing the shoe on the foot;

releasing both the insole release liner and skin release liner before placing the tape on the insole of the shoe; or putting the shoe on the foot before releasing the skin adhesive liner so as to adhere the insole adhesive to the insole of the shoe.

3. The kit of claim 1, wherein the instructions comprise instructions for removing an insole/heel tape from the insole of the shoe, the instructions comprising steps for:

providing the shoe having the tape with the insole release liner and skin released liner removed so that the insole adhesive is adhered to an insole of the shoe;

lifting the release tab from the insole; and pulling the release tab so as to remove the insole adhesive from the insole.

4. The kit of claim 3, wherein the instructions comprise steps for removing the tape from the shoe by pulling the release tab.

5. The kit of claim 3, wherein the instructions comprise steps for discarding the tape.

6. The kit of claim 3, wherein the instructions comprise steps for:

providing a second shoe having a second tape with the insole release liner and skin released liner removed so that the insole adhesive is adhered to an insole of the second shoe;

lifting the release tab of the second tape from the insole of the second shoe; and pulling the release tab so as to remove the insole adhesive of the second tape from the insole of the second shoe.

7. The kit of claim 1, wherein the instructions comprise steps for:

releasing the insole release liner from the insole adhesive of a second tape;

adhering the insole adhesive of the second tape to an insole of a second shoe;

releasing the skin release liner of the second tape; and putting the second shoe on a second foot so that the skin adhesive of the second tape adheres to skin of the heel of the second foot.

8. The kit of claim 1, wherein the substrate is plastic.

9. The kit of claim 1, wherein the substrate is shaped to have a larger heel portion and a narrowed arch portion, wherein the release tab is at the arch end of the substrate.

10. The kit of claim 1, the tape comprising a second release tab formed by a portion of the skin side of the substrate being devoid of the skin adhesive.

11. The kit of claim 1, wherein the characteristic is one or more of:

the insole side of the substrate having less stick potential compared to the skin side;

the insole adhesive having less stick potential compared to the skin adhesive;

the insole side of the substrate having more release potential compared to the skin side; or the insole adhesive having more release potential compared to the skin adhesive.

12. The kit of claim 1, wherein:

the skin adhesive is selected from acrylics, butyl rubber, ethylene-vinyl acetate, natural rubber, nitriles, silicone rubbers, styrene block copolymers, styrene-butadiene-styrene, styrene-ethylene/butylene-styrene, styrene-ethylene/propylene, or styrene-isoprene-styrene; and the insole adhesive is selected from acrylics, butyl rubber, ethylene-vinyl acetate, natural rubber, nitriles, silicone rubbers, styrene block copolymers, styrene-butadiene-styrene, styrene-ethylene/butylene-styrene, styrene-ethylene/propylene, or styrene-isoprene-styrene.

13. The kit of claim 1, wherein:

the insole adhesive covers the insole side except for the release tab; and the skin adhesive covers the entire skin side of the substrate.

14. The kit of claim 1, wherein the insole adhesive covers:

a middle region of the insole side of the substrate and a perimeter portion of the insole side of the substrate is devoid of the insole adhesive;

the entire insole side of the substrate and the ski adhesive covers the entire skin side of the substrate; or a middle region of the skin side and a perimeter portion of the skin side is devoid of the skin adhesive.

15. The kit of claim 1, wherein two of the tapes are provided in a kit with the instructions for use of the tapes, wherein the instructions are for application of the tapes to insoles of shoes and skin of heels of the wearer and for removal of the tapes from the insoles of shoes.

16. The kit of claim 1, wherein:

the insole adhesive liner covers only the insole adhesive without extending past an edge of the insole adhesive; and a skin adhesive liner covering the skin adhesive without extending past an edge of the skin adhesive.

17. The kit of claim 1, wherein the instructions include information for:

placing the narrower arch end toward the arch region of the insole during adhering the insole adhesive to the insole; and releasing the tape from the insole by initiating release from the arch region.

18. The kit of claim 1, further comprising at least one of:

the insole adhesive liner and/or skin adhesive liner being coated with silicone; or the substrate is a polyester film.

19. The kit of claim 18, further comprising:

the insole adhesive liner and/or skin adhesive liner being coated with silicone; and the substrate is a polyester film.

20. The kit of claim 1, wherein the insole adhesive liner and/or skin adhesive liner are opaque and the substrate, insole adhesive, and skin adhesive are each clear.

* * * * *